United States Patent [19]

Komatsu

[11] Patent Number: 4,854,895

[45] Date of Patent: Aug. 8, 1989

[54] SHIELDED CONNECTOR SOCKET FOR CONNECTION WITH A MULTIPIN CONNECTOR PLUG

[75] Inventor: Yasuhiro Komatsu, Osaka, Japan

[73] Assignee: Hosiden Electronics Co., Ltd., Osaka, Japan

[21] Appl. No.: 285,262

[22] Filed: Dec. 16, 1988

Related U.S. Application Data

[62] Division of Ser. No. 151,728, Feb. 3, 1988, Pat. No. 4,810,210.

[30] Foreign Application Priority Data

Feb. 12, 1987 [JP] Japan ..... 62-19484[U]

[51] Int. Cl.[4] ..... H01R 13/658

[52] U.S. Cl. ..... 439/610

[58] Field of Search ..... 439/607-610, 439/352-354

[56] References Cited

U.S. PATENT DOCUMENTS 4,337,989 7/1982 Asuck et al. ..... 439/609
4,550,960 11/1985 Asick et al. ..... 439/607
4,685,758 8/1987 Yoshida ..... 439/607

FOREIGN PATENT DOCUMENTS 2447105 8/1980 France ..... 439/353

*Primary Examiner*—Joseph H. McGlynn
*Attorney, Agent, or Firm*—Pollock, Vande Sande and Priddy

[57] ABSTRACT

A square-shaped body of an insulating material has a plurality of contact housing holes bored therethrough and arranged in a matrix form, and pin contacts are respectively housed in the contact housing holes. Cords of a shielded cable are connected at one end to the rear ends of the pin contacts. A cable clamper is put on and fixed to the shielded cable and the shield of the shielded cable is connected to the inner surface of the cable clamper. The cable clamper is fitted in and fixed to the rear end portion of a tubular shielding member made of metal and the square-shaped body is fitted in and fixed to the front end portion of the shielding member.

3 Claims, 8 Drawing Sheets

SHIELDED CONNECTOR SOCKET FOR CONNECTION WITH A MULTIPIN CONNECTOR PLUG

This is a divisional of application Ser. No. 151,728 filed on Feb. 3, 1988, now U.S. Pat. No. 4,810,210.

BACKGROUND OF THE INVENTION

The present invention relates to a multipin connector which is provided with a relatively large number of pin contacts and shielded electromagnetically.

Since conventional multipin connectors have oblong bodies, there is a limit to the number of such multipin connectors which can be mounted on a printedcirciut board along its one marginal edge thereof. On account of their oblong bodies, connection and disconnection of these multipin connectors are somewhat troublesome when they are closely arranged side by side. Furthermore, the prior art multipin connectors are not sufficiently shilded from electromagnetic noise.

It is therefore an object of the present invention to provide a multipin connector which can be mounted, in relatively large numbers, on a printed-circuit board and which provides easy connection and disconnection and is sufficiently shielded electromagnetically.

SUMMARY OF THE INVENTION

The multipin connector of the present invention employs a square-shaped plug body of an insulating material. The insulationg body has a plurality of contact housing holes bored therethrough and arranged in a matrix form. Each of the contact housing holes had housed therein a pin contact, the front end portion of which projects out of the insulating plug body for connection to a socket contact of the mating connector socket and the rear end of which is connected to one of the coreds of a shileded cable. The shielded cable is firmly clamped by a cable clamper made of metal, with the shiled (or braid) of the cable being connected to the inner surface of the clamper. The cable clamper is snugly fitted in the rear end portion of a shielding member made of metal and the above-mentioned insulating body is similarly fitted in the front end portion of the shielding member.

Since the insulating body of the multipin connector of the present invention is square, many contacts can be provided together closely and the height and width of the connector are substantially equal. Accordingly, the multipin connector of the present invention is easy to handle and can be mounted on a printed-circuit board in greater numbers than the conventional oblong multipin connectors.

DESCRIPTION OF THE PREFERRED EMBODIMENTS

Figure 1:
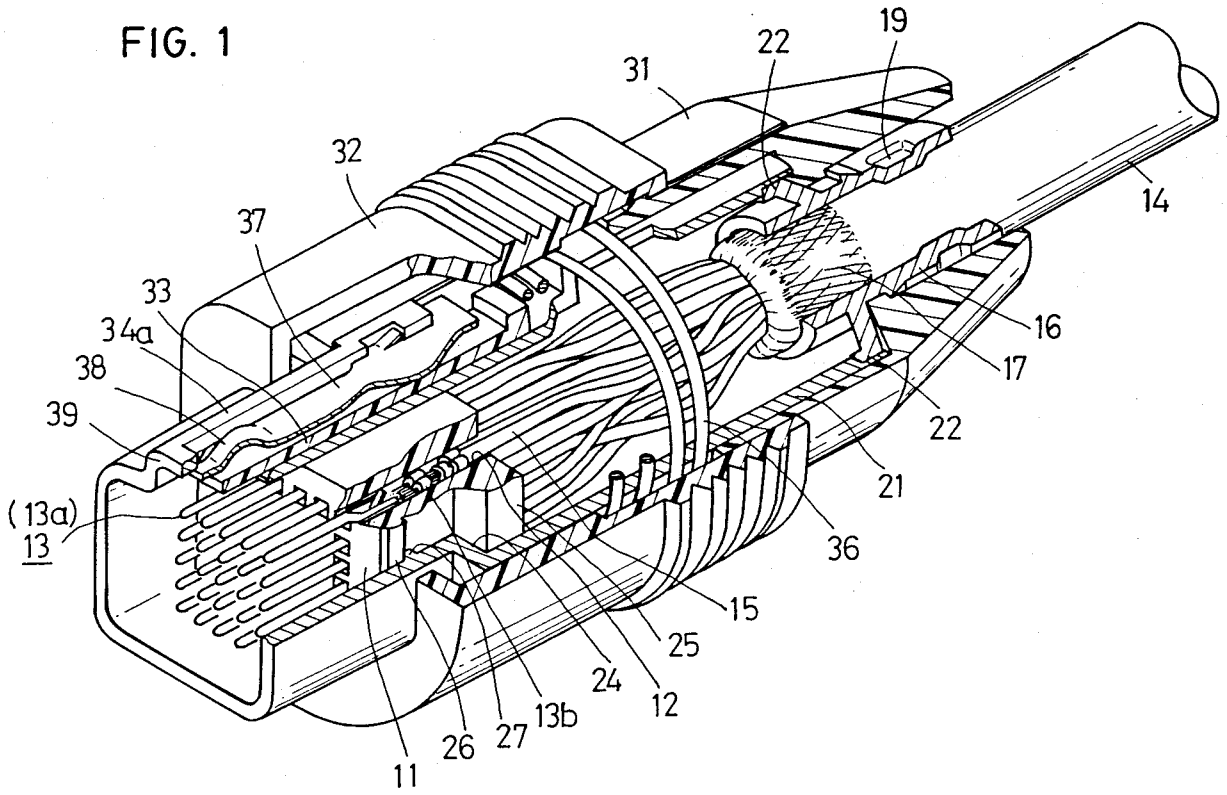
FIG. 1 is a perspective view, partly cut away, illustrating an example of the multipin connector of the present invention.
Figure 2:
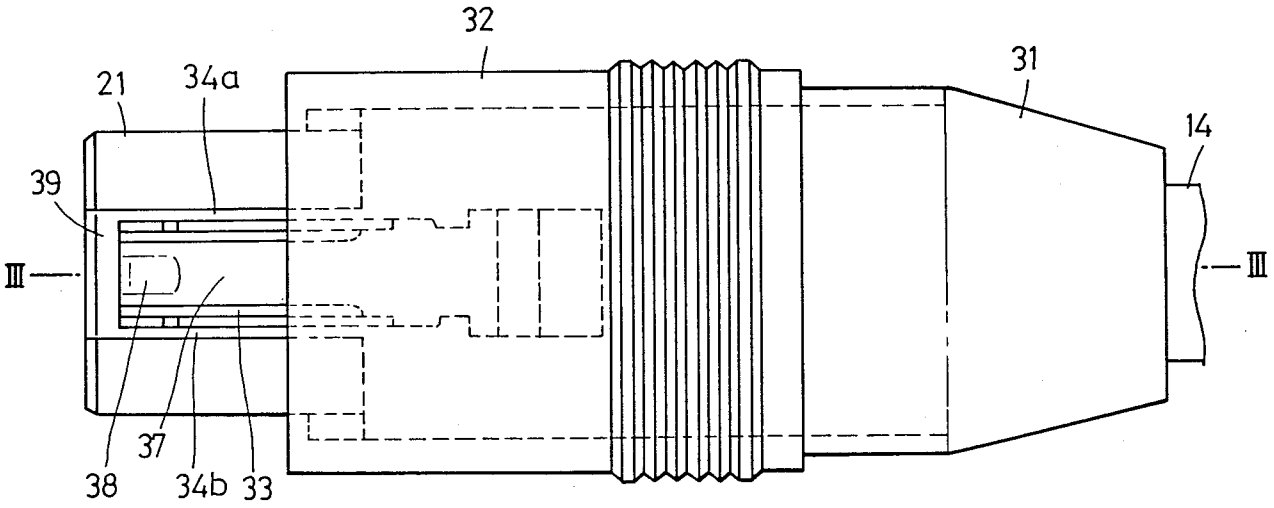
FIG. 2 is a plan view of the multipin connector shown in FIG. 1.
Figure 3:
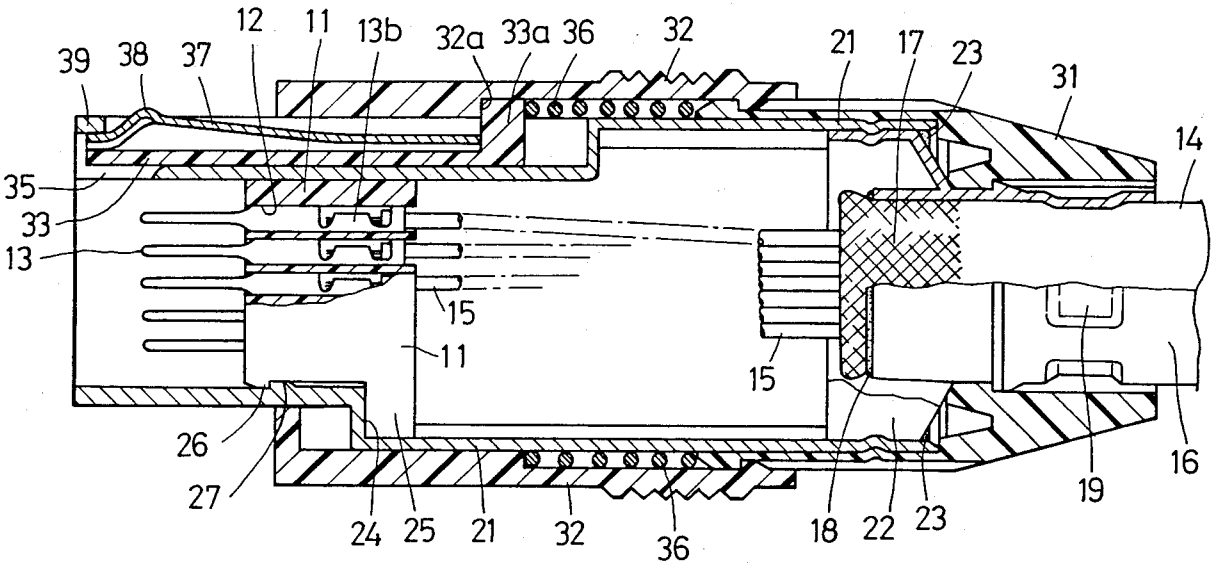
FIG. 3 is a longitudinal-sectional view taken along the line III—III in FIG. 2.
Figure 4:
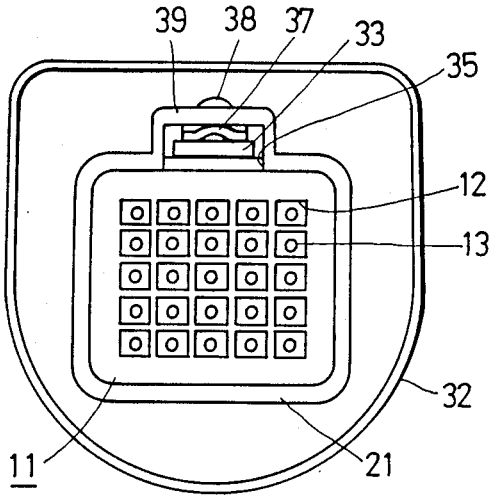
FIG. 4 is a left side view of the multipin connector shown in FIG. 2.
Figure 5:
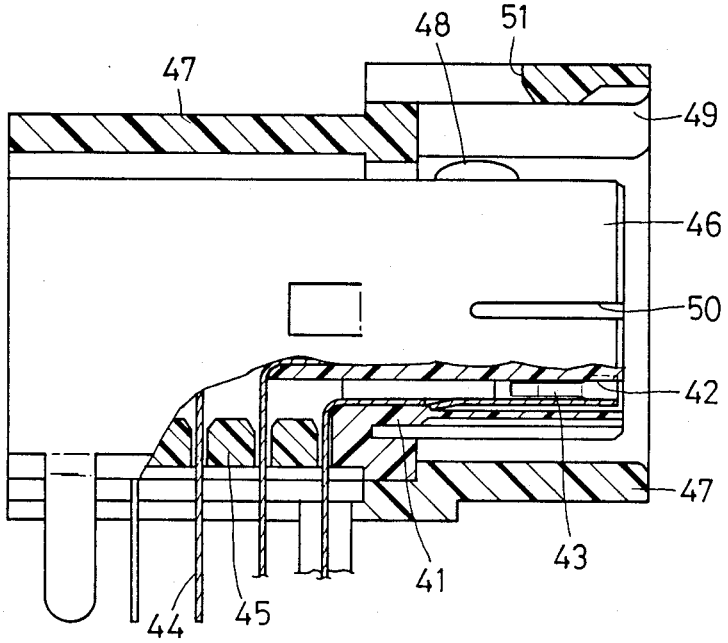
FIG. 5 is a front view, partly cut away, showing an example of a mating connector.
Figure 6:
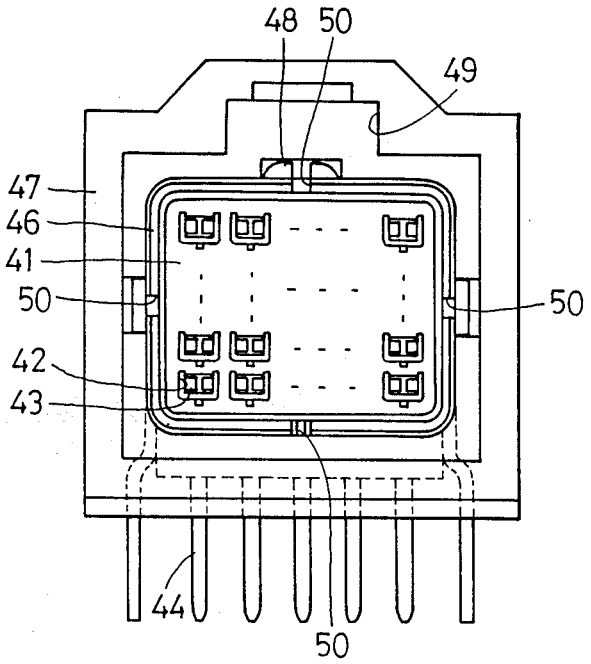
FIG. 6 is a right side view of the mating connector shown in FIG. 5.
Figure 7:
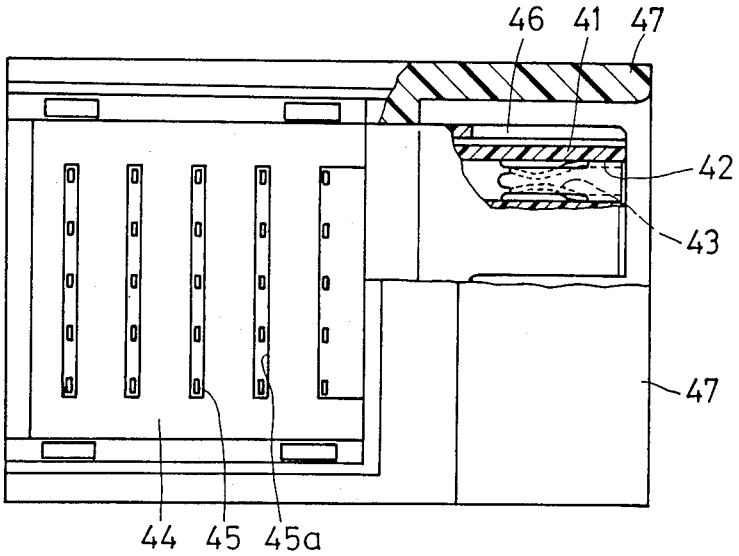
FIG. 7 is a bottom view, partly cut away, of the mating connector.

FIGS. 1 to 4 illustrate an embodiment of the present invention. Reference numeral 11 indicates a body of an insulating material which is square in shape and hence has substantially square front and rear end faces. The insulating body 11 has contact housing holes 12 bored therethrough in its front-to-back direction and arranged in a matrix form with five rows and five columns in this embodiment. Each of the contact housing holes 12 has housed therein a pin contract 13, the front end portion of which forms a contact portion 13*a* projecting out of the front end face of the insulationg body 11 and the rear end portion of which forms a cord connecting portion 13*b*.

A shielded cable 14 has a plurality of cords 15, each of which is fixedly connected at one end to the cord connecting portion 13*b* of one of the pin contacts 13. A cable clamper 16 made of metal firmly clamps the shielded cable 15 inserted therethrough, with its shield (or braid) 17 folded back onto the cable armor. The shield 17 is soldered to the front end of the cable clamper 16, as indicated at 18 in FIG. 3. The cable slamper 16, pressed around a clamping portion 19 thereof, fixedly clamps the cable 14.

The cable clamper 16 is fitted into and fixed to the rear end portion of a tubular shielding member 21 made of metal. The cable clamper 16 has, on the radially outside of the front end portion thereof, an engaging portion 22 formed concentrically and integrally therewith, the engaging portion 22 being received in the rear end portion of the shielding member 21 and soldered thereto, asw indicated by 23 in FIG. 3.

The insulating body 11 is held in the forward portion of the shielding member 21. The forward portion of the shielding member 21 is square-sectioned in conformity to the insulating body 11. The insulating body 11 is pressed into the square-sectioned portion from behind through the rear end portion of the shielding member 21 whose inner diameter is greater than that of the square-sectioned portion. The insulationg body 11 has a flange 25, which abuts against a stepped portion 24 of the shielding member 21 when the insulating body 11 is fitted therein. A circumferential ridge 26 extending around the outer periphery of the insulationg body 11 is engaged with a lug 27 of the shielding member 21 so that the insulating body is held in position.

The multipin connector of this embodiment is provided with means for locking with the mating connector socket. A protector portion 31 is fixedly mounted on the rear end portion of the shielding member 21 in a manner to surround the cable clamper 16. The front end portion of the protector portion 321 engages the rear end portion of shielding member 21, and a cover 32 covering the shielding member 21 is provided in a manner to be movable back and forth. Provided between the shielding member 21 and the cover 32 is an elastic sliding piece 33 which is slidable back and forth relative to the cover 32. Guide ridges 34*a* and 34b for the sliding piece 33 are formed integrally with the shielding member 21. The shielding member 21 has a cutaway 35 in opposing relation to the forward end portion of the sliding piece 33 so that the front end portion of the sliding piece 33 may bend toward the axis of the connector for engagement with a part of the mating connector socket inserted into the front end portion of the shielding member 21. The sliding piece 33 is biased forward at all times. That is, a coiled spring 36 is wound around the shielding member 21 between a rear end portion 33*a* of the sliding piece 33 and the front end of the protector portion 31. For unlocking the connector plug from the mating connector socket, the rear end portion 33*a* of the sliding piece 33 is pulled back by a stepped portion 32*a* of the sliding cover 32 against the biasing force of the coiled spring 36 so that a projection 38 of a spring piece 37 can be submerged below the top level of the guide ridges 34*a*, 34*b*.

The spring piece 37 is disposed opposite the sliding piece 33 on the outside thereof and held between the guide ridges 34*a* and 34*b*, so that its lateral movement is limited by them. The spring piece 37 has the projection 38 at its front end portion, and the front end of the projection 38 engages a bridge portion 39, preventing the spring piece 37 from movement in a direction opposite from the sliding piece 33.

Figure 8:
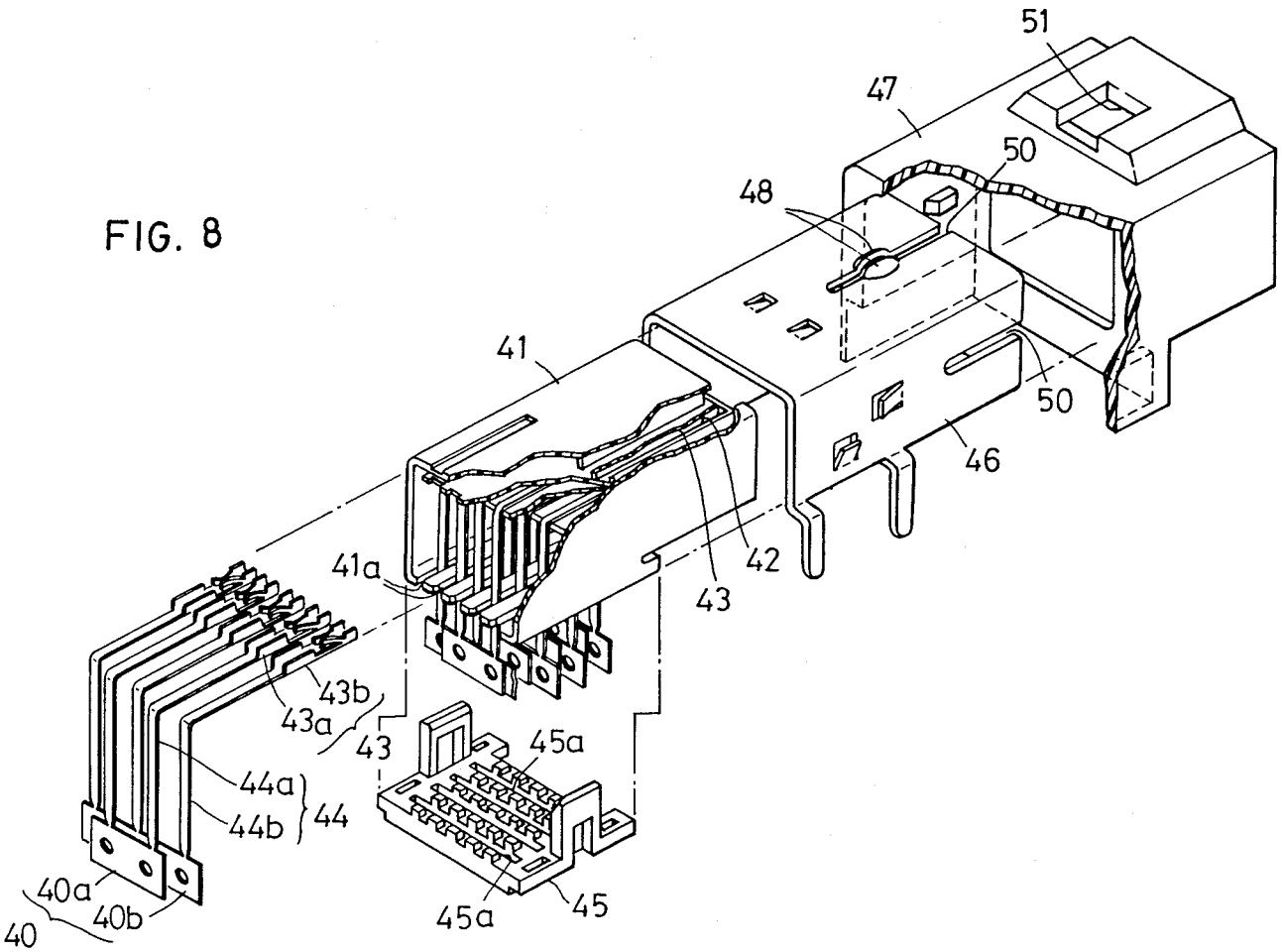
FIG. 8 is an exploded perspective view of the mating connector.

Next, a description will be given, with reference to FIGS. 5 to 8, of the mating connector socket for connection to the multipin connector of the present invention described above. A square-sectioned body 41 of an insulating material has, in its forward portion, contact housing holes 42 bored therethrough and arranged in a matrix form, and each contact housing hole 42 houses therein a socket contact 43. The back portion of the insulating body 41 is hollow and its rear end is open. The bottom of the back portion of the body 41 has slots 41a extending lengthwise thereof and open at the rear end thereof. As shown in FIG. 8, the socket contacts 43 extend rearward and are bent down, at right angles, at different positions in their lengthwise direction so that their bent portions, each forming a terminal 44, may lie apart. In this exmaple, since it is difficult to make such laterally closely-packed socket contacts 43 out of a single sheet of metal, socket contact arrays 43*a* and 43*b* are each made of a sheet of metal and they are assembled together so that their socket contacts 43 may lie alternately with each other. The terminals 44 (44*a*, 44*b*) of the socket contacts 43 project out of corresponding slots 41*a* made in the bottom of the insulating body 41 at the rear end portion thereof. The bottom of the insulationg body 41 open at the rear end portion is covered with a bottom panel 45 which has lateral slots 45*a* through which terminal coupling portions 40 (40*a*, 40*b*) project downwardly thereof. The terminal coupling portions 40 are cut off after assembling.

The insulating body 41 is coverd with a rectangular tubular shielding member 46, which is, in turn, covered with a square-sectioned tubular case 47 made of an insulating material. When this connector socket is coupled with the multipin connector shown in FIGS. 1 to 4, the forward portion of the shielding member 46 is fitted into the forward portion of the shielding member 21 of the multipin connector. The forward portion of the shielding member 46 has a plurality of slots 50 so that it may elastically engage the shielding member 21. The top surface of the shielding member 46 has a locking protrusion 48 formed by embossing. The case 47 has a recess 49 formed in its inner surface in opposing relation to the protrusion 48 and its vicinity, for receiving the bridge portion 39 and the guide ridges 34*a* and 34*b* of the multipin connector. Furthermore, the case 47 has a hole 51 made in a ceiling 49*a* of the recess 49 in opposing relation to the protrusion 48.

Figure 9A:
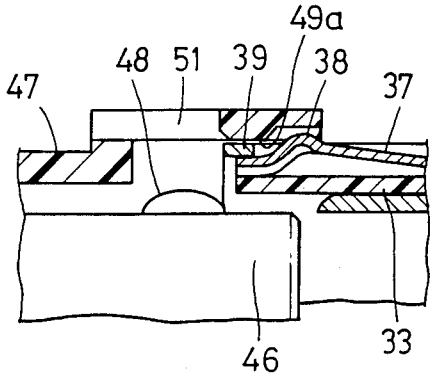
FIGS. 9A to 9C are sectional views, for explaining a locking mechanism used in the present invention.
Figure 9B:
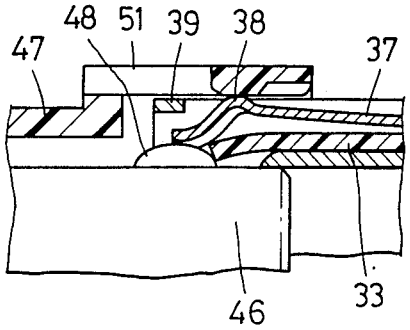
Figure 9C:
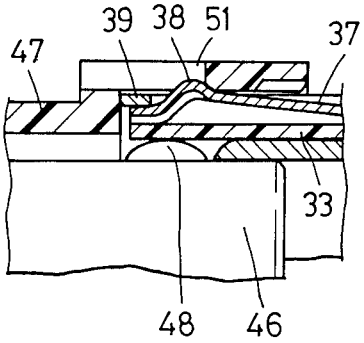

When this mating connector socket is coupled with the multipin connector, the bridge portion 39 and the guide ridges 34*a* and 34*b* of the latter are partly inserted into the recess 49, as shwon in FIG. 9A. When further pressing themating connector socket into the multipin connector, the projection 38 of the spring piece 37 is urged against the ceiling 49*a* of the recess 49, and consequently the spring piece 37 is pushed downward, thereby elastically bending the front end portion of the sliding piece 33 down. Accordingly, the protrusion 48 strikes against the tip of the sliding piece 33, sliding it backward, as shown in FIG. 9B. When the front end portion of the shielding member 21 is further forced into the recess 49, the projection 38 of the spring piece 37 moves into engagement with the hole 51, as depicted in FIG. 9C. That is, the sliding piece 33 is disengaged from the protrusion 48 and restored to its initial form and, by the force of the coiled spring 36, the spring piece 33 overrides the protrusion 48, locking the projection 38 in the hole 51. In this state, the pin contacts 13 are each held in and engaged with the corresponding socket contact 43.

To unlock the multipin connector from the mating connector socket, the cover 32 needs only to be pulled back against the biasing force of the coiled spring 36, in consequence of which the sliding piece 33 is also pulled back and out of engagement with the protrusion 48, permitting easy disengagement of the projection 38 from the hole 51.

Figure 10:
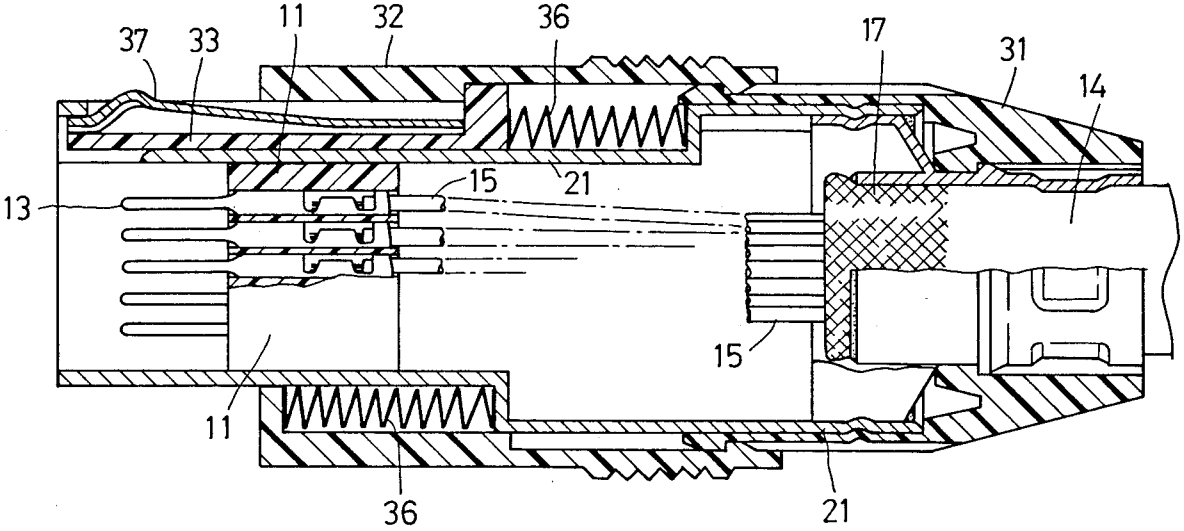
FIG. 10 is a sectional view illustrating another embodiment of the present invention.

Incidentally, the coiled spring 36 need not always be wound around the shielding member 21 but instead a plurality of small windings may also be utilized so as to reduce the size of the cover 32, as shown in FIG. 10.

As described above, the multipin connector of the present invention employs a square-sectioned insluating body, which can hold contacts concentratively and the four sides of the square section can be made substantially equal to one another; accordingly, the multipin connector of the present invention is relatively round as a whole and can easily be gripped for connection to and disconnection from the mating connector socket. A number of such multipin connectors can be mounted on one marginal edge of a printed circuit board. Moreover, the internal structure from the contacts to the cable connecting portion is disposed within the shielding member 21, and hence is shielded from electromagnetic waves. Besides, since the locking mechanism is disposed outside the shielding member 21 in the example described above, the electromagnetic shield is not affected by the locking mechanism.

It will be apparent that many modifications and variations may be effected without departing from the scope of the novel concepts of the present invention.

What is claimed is:

1. A connector socket for connection with a multipin connector plug comprising:

a square shaped body of an insulating material having a plurality of socket contact holes therein arranged in a matrix form;

a plurality of socket contacts housed in said socket contact holes, respectively, for engagement with a plurality of pin contacts of a multipin connector plug;

a square shaped shielding member made of metal mounted around said square body; and a square shaped case covering said square shaped shielding member, said case having a recess formed in an inner wall surface thereof at the front end portion thereof for receiving part of the multipin connector plug and an engaging step formed in said recess for engagement with said part of said multipin connector plug.

2. The connector socket of cliam 1 wherein said square shaped shielding member includes a protrusion formed integrally therewith on an outer surface thereof in opposing relation to said recess.

3. The connector socket of cliam 1 or claim 2 wherein said square shaped shielding member has a plurality of slots cut therein which extend from the front end thereof in its axial direction to allow elastic engagement of said shielding member with the multipin connector plug.

* * * * *